US010081935B2

(12) United States Patent
Beck et al.

(10) Patent No.: US 10,081,935 B2
(45) Date of Patent: Sep. 25, 2018

(54) BRACE SUPPORT DEVICE

(71) Applicant: PF Waterworks LP, Houston, TX (US)

(72) Inventors: Harold Kent Beck, Copper Canyon, TX (US); Sanjay Ahuja, Katy, TX (US)

(73) Assignee: PF Waterworks LP., Houston, TX (US)

( * ) Notice: Subject to any disclaimer, the term of this patent is extended or adjusted under 35 U.S.C. 154(b) by 0 days.

(21) Appl. No.: 15/490,752

(22) Filed: Apr. 18, 2017

(65) Prior Publication Data

US 2017/0306599 A1 Oct. 26, 2017

Related U.S. Application Data

(60) Provisional application No. 62/325,762, filed on Apr. 21, 2016.

(51) Int. Cl.

| | |
|---|---|
| ***A47F 5/00*** | (2006.01) |
| ***E03D 1/012*** | (2006.01) |
| ***F16M 13/02*** | (2006.01) |
| *E03C 1/32* | (2006.01) |

(52) U.S. Cl.
CPC ..... *E03D 1/012* (2013.01); *F16M 13/02* (2013.01); *E03C 1/32* (2013.01)

(58) Field of Classification Search
CPC ..... E03D 1/012
USPC ..... 248/354.3; 132/323; 2/174; 4/252.2, 4/252.4
See application file for complete search history.

(56) References Cited

U.S. PATENT DOCUMENTS

| | | | | |
|---|---|---|---|---|
| 2,233,342 | A * | 2/1941 | Crozier | E03C 1/322 4/648 |
| 2,810,136 | A * | 10/1957 | Kearney | E03D 1/26 248/312.1 |
| 3,404,476 | A * | 10/1968 | Hoffman, Jr. | G09F 7/16 24/DIG. 11 |
| 3,666,225 | A * | 5/1972 | Weinberger | E03D 1/01 248/205.3 |
| 9,874,492 | B2 * | 1/2018 | Cutsforth | H01R 39/41 |
| 2015/0191902 | A1 | 7/2015 | Vadnais | |

FOREIGN PATENT DOCUMENTS

| | | | | |
|---|---|---|---|---|
| WO | WO-2014028315 A1 * | 2/2014 | | E03D 1/012 |

* cited by examiner

*Primary Examiner* — Todd M Epps
(74) *Attorney, Agent, or Firm* — Stephen S. Hodgson

(57) ABSTRACT

A brace includes two or more spacers connected together using an interlocking mechanism, such as a press fit, an interference fit, a friction fit, a snap fastener, a projection-and-recess coupling system or a stud-and-tube coupling system, to provide a desired combined length. The brace may further include a U-shaped clip for attachment to a toilet tank or may use a plate with an adhesive layer for attachment to an object. The brace may also include a threaded stud and a nut coupled to a spacer for adjusting the combined length of the brace.

24 Claims, 2 Drawing Sheets

BRACE SUPPORT DEVICE

CROSS REFERENCE TO RELATED APPLICATIONS

This application claims priority to and the benefit of U.S. Provisional Patent Application Ser. No. 62/325,762 filed on Apr. 21, 2016, which is incorporated by reference in its entirety.

BACKGROUND OF THE INVENTION

1. Field of the Invention

This present invention pertains to a brace, particularly for providing horizontal or vertical support between adjacent objects, and more particularly to a brace for supporting a toilet tank against a wall.

2. Description of the Related Art

A toilet tank holds water for flushing waste from a toilet bowl. The toilet tank is fastened to the toilet bowl by two bolts in the bottom of the toilet tank. The toilet tank is often adjacent to a wall, but with a gap distance that ranges from one-half of an inch to several inches between the toilet tank and the wall. A lateral force against the tank towards the wall can cause the tank or the toilet bowl to crack or break. Various devices have been disclosed for bracing the tank against a wall. U.S. Pat. No. 3,666,225, issued to Weinberger, describes a stabilizer bracket that hooks over the back of a toilet tank and a compression member, where the length of the stabilizer bracket can be adjusted to a desired length by cutting the compression member or by threading a collar onto the compression member. U.S. patent application Ser. No. 2015/0191902 A1 by Vadnais describes a stabilizer support that includes a clip for fastening to a toilet tank, a foot plate that presses against a wall and a beam having a T-shaped cross-section that is received in and extends between the clip and the foot plate. The beam is cut to a desired length.

SUMMARY OF THE INVENTION

In one embodiment, the present invention provides a brace that comprises a mounting bracket or connector for fastening the brace to an object and a spacer detachably attached to the mounting bracket via an interlocking mechanism. The mounting bracket is preferably a U-shaped clip that hangs on a top edge of a toilet tank, preferably with some spring action for squeezing against the tank wall, or a plate with an adhesive layer for adhering the plate to an object. The brace preferably includes a threaded stud along the longitudinal axis of the brace and a nut threadedly engage with the stud for adjusting the combined length of the brace. In an application for bracing a toilet tank against a wall, the brace preferably includes a U-shaped clip for attachment to the toilet tank, a threaded skid projecting from the clip towards the wall, a nut having a threaded opening on one side for threading onto the stud and an interlocking mechanism on the other side, preferably including a spacer connected to the nut via a mating interlocking mechanism, possibly including one or more additional spacers connected together by interlocking means and connected to the spacer connected to the nut, and preferably including an end cap that has an interlocking mechanism on one side for assembly with the brace and a surface on the other side designed to press against a support wall. In another embodiment, a brace according to the present invention includes means for attaching the brace to an object, at least one spacer either detachable attached to the attachment means or detachably attached to an adjusting nut that is threadedly connected to the attachment means, where the brace can be used in a horizontal or a vertical orientation or in an orientation that is neither horizontal nor vertical. In the particular application for bracing a toilet tank against a wall, the brace preferably has a generally cylindrical shape, and the interlocking mechanism is preferably a projection-and-recess coupling system, preferably where the projection is a male cylinder and the recess is a female cylinder with the male cylinder received inside the female cylinder in an interference or friction fit.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

A brace is described herein for bracing and thereby supporting a toilet tank against a wall. The brace may also have other applications for bracing and supporting an object that is near a wall. The brace may also serve as a spacer in a vertical orientation, such as for leveling an object resting on a floor.

Figure 1:
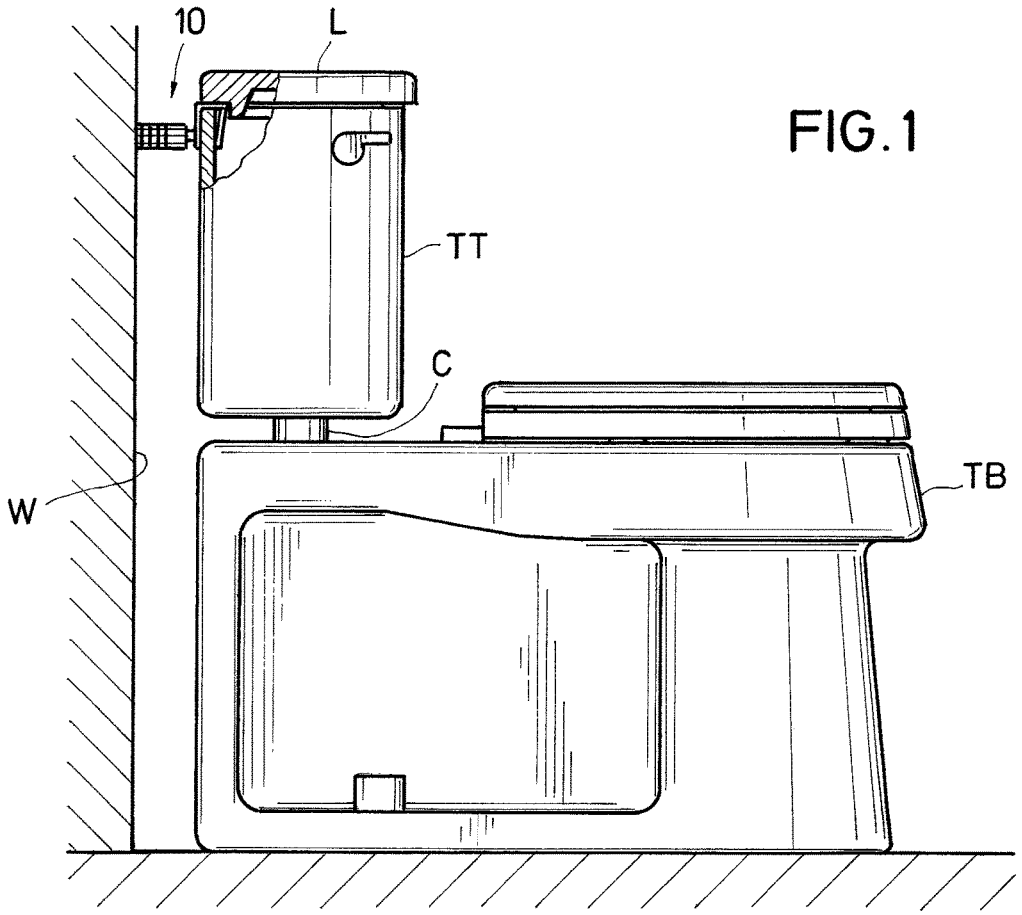
FIG. 1 is a side elevation of a brace between a wall and a toilet tank, which rests on and is fastened to a toilet bowl, according to the present invention.

With reference to FIG. 1, a side elevation of a brace 10 is shown connected to a toilet tank TT and extending to a wall W for supporting the toilet tank TT against the wall W. The toilet tank TT is connected to and sealed with a toilet bowl TB using a conventional connection C, the details of which are not shown in FIG. 1, but are described as follows. The toilet tank has a centralized opening in a bottom wall. The toilet bowl has a mating opening with an upwardly extending flange. A gasket is received on the flange below the toilet tank. Each of the toilet tank and the toilet bowl has a bolt hole on each side of its respective opening. A pair of bolts secure the toilet tank to the toilet bowl in a watertight seal provided by the gasket. The toilet tank is illustrated as spaced from the wall by about three inches or about 5 to 10 cm. Without the brace 10, the: only support for the tank against a lateral force is through the bolts at the bottom of the tank.

Figure 2:
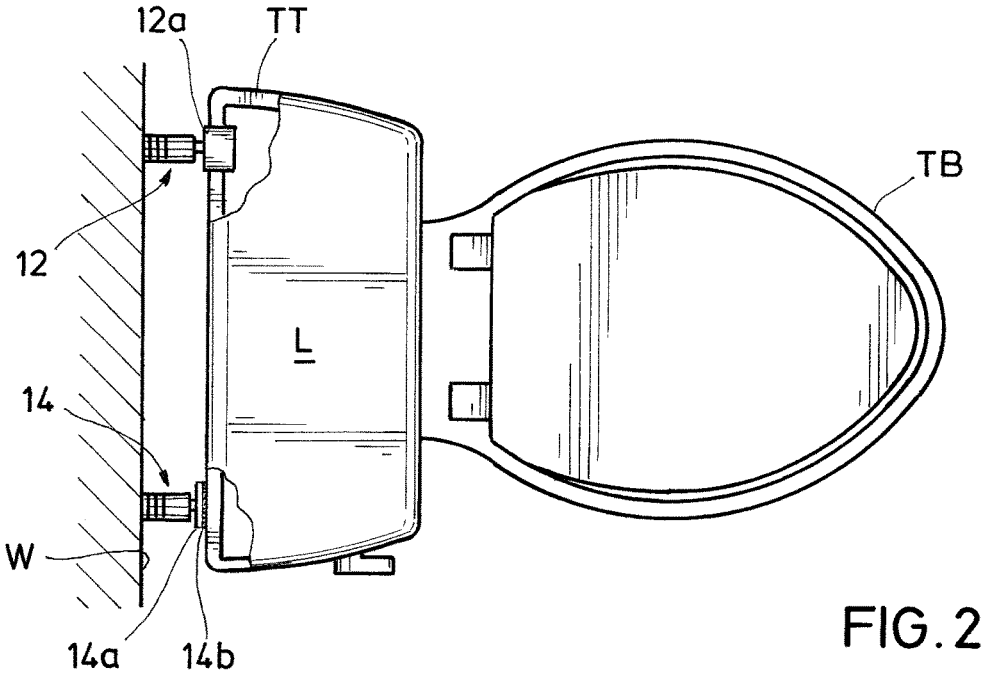
FIG. 2 is a top plan view of two braces between a wall and a toilet tank, which rests on and is fastened to a toilet bowl, according to the present invention.

FIG. 2 is a top plan view showing a pair of braces 12 and 14 spaced between the toilet tank TT and the wall W. A lid L covers the tank TT and is shown partially cut away to fully expose a top view of the braces 12 and 14. Brace 12 is fastened to the tank TT by a downwardly-facing, U-shaped clip 12*a*. An alternative way of connecting a brace to a toilet tank is to glue or bond the brace to the toilet tank. Brace 14 has a plate 14*a* and a layer of adhesive 14*b*, which bonds the brace 14 to the toilet tank TT. A brace according to the present invention can be used in applications other than for bracing a toilet tank, where the use of a flat or shaped plate and an adhesive may be a better fastener system than a U-shaped clip.

Figure 3:
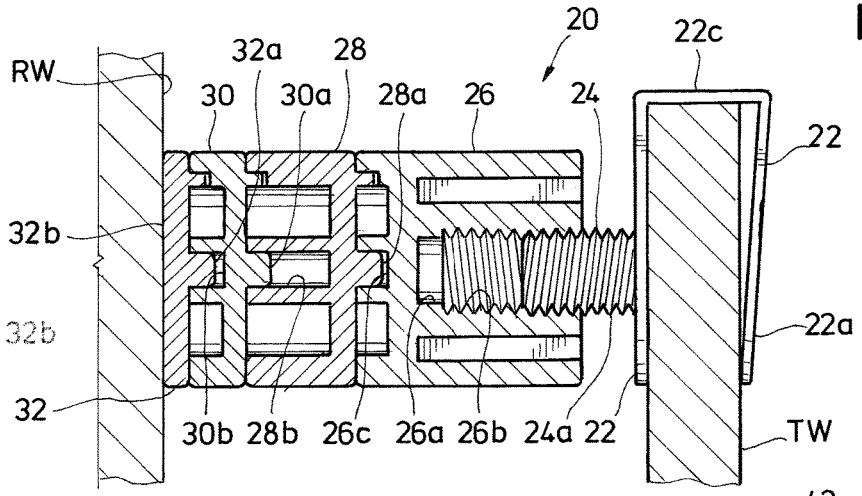
FIG. 3 is a side elevation of the cross-section of a brace, according to the present invention.

FIG. 3 is a cross-sectional side elevation of a brace 20 between a toilet tank wall TW and a room wall RW. A U-shaped clip 22 rests on an upper edge of the tank wall TW. Clip 22 has opposing side plates 22*a* and 22*b* connected by a base plate 22*c*. A stud 24 is fixed to and projects perpendicularly from the clip side plate 22*b*. Stud 24 has male threads 24*a*. A nut 26 has a central longitudinal hole 26*a* on one end, and the sidewall that defines the hole 26*a* has female threads 26*b*. Nut 26 is threaded onto stud 24. The other end of nut 26 has a central longitudinal recess 26*c*. A first spacer 28 has a central longitudinal projection 28*a* on one end sized for and pressed into the recess 26*c* in an interference fit, which fastens the first spacer 28 to the nut 26 in an attachable-detachable coupling system. The other end of the first spacer 28 has a central longitudinal recess 28*b*. A second spacer 30 has a central longitudinal projection 30*a* on one end, which preferably has the same size, shape and location as the projection on the first spacer 28. The projection 30*a* is pressed into a friction fit or interference fit with the recess 28*b* on the first spacer 28. A recess 30*b* is provided on the end opposite the projection 30*a*. The recess 30*b* preferably has the same size, location and shape of the recess 28*b* for uniformity of parts. An end cap 32 has a central longitudinal projection 32*a* sized and located for reception in the recess 30*b* of the second spacer 30, which detachably attaches the end cap 32 to the second spacer 30. End cap 32 has a surface 32*b* on its end opposite the projection 32*a*. Surface 32*b* rests against or presses against the room wall RW and is preferably generally planar or flat.

The first and second spacers 28 and 30, respectively, have different lengths, and more spacers can be used, which provides flexibility in arranging a number of spacers so that the brace 20 fits reasonably well in the space between the toilet wall TW and the room wall RW. A final adjustment to the length of the assembled brace 20 is made by rotating the nut 26 with respect to the stud 24, which alters the combined length of the tank brace 20 for bracing the toilet tank against the room wall RW so that the room wall provides support for the toilet tank to resist a lateral force that tends to push the toilet tank toward the room wall.

Figure 4:
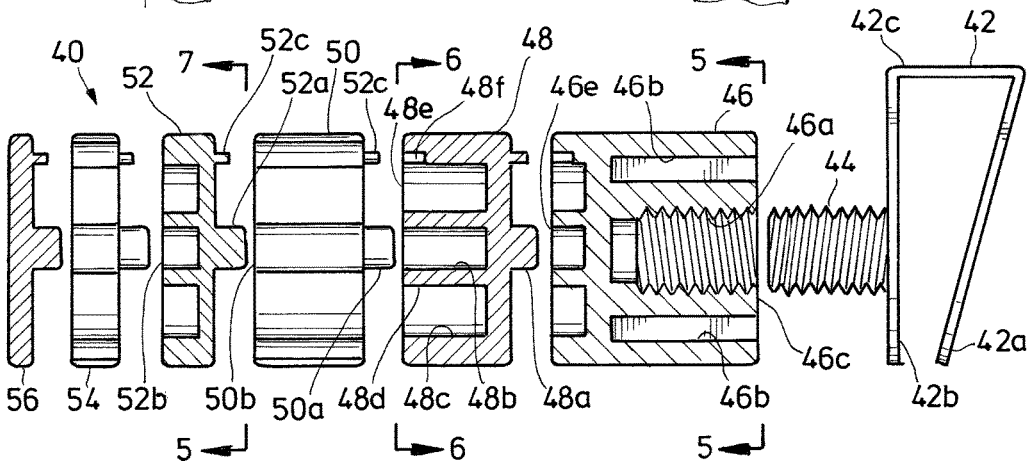
FIG. 4 is an exploded view of a brace, according to the present invention.
Figure 5:
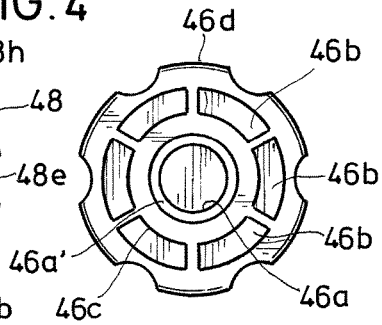
FIG. 5 is a side elevation view of an adjusting nut as would be seen along the line 5-5 in FIG. 4.

FIG. 4 is an exploded-view drawing of a tank brace kit 40. The kit 40 includes a U-shaped dip 42; a threaded stud 44 projecting from the clip 42; a nut 46 that has female threads for threaded engagement with the stud; first, second, third and fourth spacers 48, 50, 52 and 54, respectively; and an end cap 56. The U-shaped clip has opposing sides 42*a* and 42*b*, which are connected together by a base 42*c*. The angle between the side 42*a* and the base 42*c* is acute, and the clip 42 is preferably made of a material that has a spring-like resilience. The sides 42*a* and 42*b* press against a toilet tank wall for securing the tank brace to the toilet tank in a friction fit. An alternative to the U-shaped clip 42 is a flat plate such as plate 42*b* and an adhesive for bonding the plate to the toilet tank wall. In either embodiment the stud 44 should point towards the room wall. Nut 46 is shown in cross-section. FIG. 5 is a view of the full nut 46 as seen along the line 5-5. Nut 46 has a central recess 46*a* that is defined by female threads 46*a*' for engagement with stud 44. For a reduction in material cost, nut 46 has a number of voids 46*b*. An internal cylinder 46*c* is connected by a web of material between the voids 46*b* to an outer cylinder 46*d*. The central recess 46*a* is within the internal cylinder 46*c*. Nut 46 has an interlocking recess 46*e* on its end opposite the threaded recess 46*a*.

Figure 6:
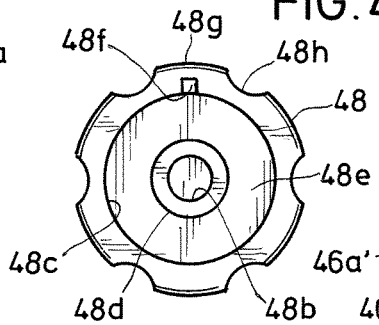
FIG. 6 is a side elevation view of a typical spacer, as seen along the line 6-6 in FIG. 4.

First spacer 48 in FIG. 4 is shown is cross-section and has an interlocking projection 48*a* for a press-fit engagement with the interlocking recess 46*e* in nut 46. First spacer 48 has an interlocking recess 48*b* opposite its projection 48*a*. FIG. 6 is a view of the full first spacer 48 as seen along the line 6-6 in FIG. 4. First spacer 48*a* has an outer cylindrical wall 48*c* and an inner cylindrical wall 48*d*. Walls 48*c* and 48*d* define an annular void space 48*e*. The outer wall has a notch or pin hole 48*f*. Second spacer 50 has an interlocking projection 50*a* that press fits in recess 48*b* and an opposing interlocking recess 50*b*. Second spacer 50 has a projecting pin 50*c* that fits in the pin hole 48*f* in first spacer 48. As can be seen in FIG. 6, the first spacer has a plurality of ridges 48*g* and valleys 48*h* spaced around an outer circumference. The nut, each of the spacers and the end cap 56 have corresponding ridges and valleys. The pin 50*c* is received in the pin hole 48*f*, which tends to prevent the second spacer 50 from rotating with respect to the first spacer 48, thereby keeping the ridges and valleys in alignment. Corresponding pins and pin holes are provided in each of the nut, the spacers and the end cap for keeping the ridges and valleys along the brace in alignment. The ridges and valleys around the nut 46 provide a gripping surface for rotating the nut. Third spacer 52 has an interlocking projection 52*a*, an interlocking recess 52*b* and a protruding pin 52*c*.

Figure 7:
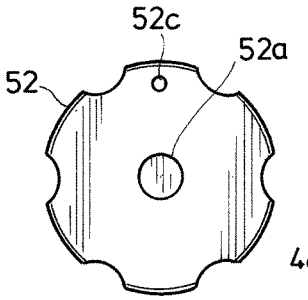
FIG. 7 is a side elevation of a thin spacer as would be seen along the line 7-7 in FIG. 4.

FIG. 7 is a view of third spacer 52 as seen along the line 7-7. The interlocking pin and pin hole combination, which is for preventing rotation of one spacer with respect to another spacer for keeping the ridges and valleys in alignment, is an optional feature. A smooth cylindrical shape with a circular cross-section could be used, where there would be no need for maintaining an alignment. An alternative design, which would maintain alignment, is for the projection-recess coupling system to have a non-circular cross-section. For example, the recess 48*b* and the projection 50*a* could each have a mating non-circular cross-section, such as a rectangular or oval cross-section, which would provide an interlocking mechanism that would not readily allow rotation of one spacer with respect to another spacer or with respect to the adjusting nut 46. Another alternative design, which would maintain alignment, is for the projection-recess coupling system to have more than one recess, such as two, three or four recesses, and a mating number of projections.

A kit such as the kit in FIG. 4 can have more than one brace, preferably two braces for the arrangement shown in FIG. 2. A number of different spacers of different lengths can be included so that different combinations are suitable for different gaps between a toilet tank and a wall. Prior art braces such as described in U.S. patent application Ser. No. 2015/0191902 A1 by Vadnais required cutting an element to fit a particular gap, but a brace according to the present invention does not require that an element be cut. There is no need to cut anything to size or length with a brace according to the present invention. One merely determines a gap distance between a toilet tank and a wall; threads an adjusting nut onto a stud on a U-shaped clip; assembles a combination of spacers that with the adjusting nut has a combined length of slightly less than the gap distance; remove the toilet tank lid; place the U-shaped clip on a top edge of a back wall of the toilet tank (or stick a plate on the outside back wall with an adhesive); rotate the adjusting nut to increase the combined length of the brace to the gap distance so that the brace presses against the room wall and supports the toilet tank against the room wall; repeat if desired to use a second tank brace; and replace the lid on the toilet tank.

The adjusting nut allows one to obtain a reasonably precise combined length for the brace. The threaded stud 44 does not necessarily need to be attached to the mounting bracket 42. A threaded stud can be anywhere along the longitudinal axis of the brace, such as on the end cap 56, with an adjacent adjusting nut. However, the threaded stud and the adjusting nut are not required and can be eliminated from the brace. A different U-shaped clip or adhesive-lined plate can be used in which the threaded stud is eliminated and replaced with an interlocking mechanism, preferably a recess for receiving a projection such as the projection 48*a* on the first spacer 48 in FIG. 4 in an interference fit. A combination of spacers can be assembled to provide a combined length that is most suitable for a particular gap distance. The projection-recess coupling system described above could have two, three, four or more recesses and two, three, four or a mating number of projections, which provides a different way to prevent rotation of one member with respect to another member or spacer. Different interlocking mechanisms can be used instead of the projection-recess coupling system described in reference to FIGS. 3 and 4. The projection-recess coupling system described with reference to FIGS. 3 and 4 could be called a stud-and-tube coupling system. However, that terminology is also used with reference to toy building blocks described in U.S. Pat. No. 3,005,282, issued to Christiansen, assigned to Interlego, A. G. and incorporated by reference. The interlocking mechanism described in the U.S. Pat. No. 3,005,282 patent does not place a projection inside a tube. The U.S. Pat. No. 3,005,282 patent describes building blocks in which an upper surface has projecting studs and a lower surface has a tubular structure such as seen in FIG. 6 herein, except the blocks or bricks in the '282 patent have a square or rectangular shape rather than the cylindrical wall 48*c* shown in FIG. 6. The studs on a brick or block in the '282 patent are not received inside a tube, but are instead received in a space between an outer surface of a tube and a wall and or with the outer surface of an adjacent tube. A stud in the '282 patent is received in a space defined by the outside wall of one or more tubes and an inside wall of a brick or block. The interlocking mechanism described in the '282 patent has been referred to as a stud-and-tube coupling system, which can be used for a brace according to the present invention. Prior art patents are cited in the '282 patent, which may describe other types of interlocking mechanisms. A snap fastener such as described in U.S. Pat. No. 2,397,801, issued to Mitchell, is another type of interlocking mechanism that can be used in making a brace according to the present invention.

A brace according to the present invention is an assembly of spacers connected together by an interlocking mechanism. The brace has been described for use in a horizontal position with a clip for attachment to a toilet tank. A plate with an adhesive layer instead of the U-shaped clip may make the brace useful in other applications for bracing an object against a structure, such as a wall. A plate and a mechanical fastener such as one or more wood or machine screws is another way of attaching the brace to a thing that needs to be supported or braced. A brace according to the present invention can also be used in a vertical position. One application is the leveling and stabilization of chairs and tables on an uneven floor. Instead of the U-shaped clip 22, the stud 24 and the nut 26 in FIG. 3, one could use a plate with an adhesive layer on one side and an interlocking mechanism on the other side. The spacers can be much thinner, since a gap distance may be less than one-half of an inch or less than 1.5 cm, but can nevertheless have an interlocking mechanism for assembling a combination that has a desired combined length. Vertical applications include support for tables, chairs, shelving units, cabinets, furniture, laboratory equipment, shop equipment, tools, machines, tripods, stands and scaffolding. It may he desirable to use a material of construction that is more compressible or more resilient in applications as vertical spacers than in a horizontal application. A tank brace according to the present invention is preferably made of a generally rigid, but not brittle, thermoplastic polymeric material, while a vertical spacer may be made of a semi-rigid thermoplastic or a semi-rigid polymeric foam that has greater compressibility than is used in a horizontal application. However, the selection of a material depends on the application, and a metal could be used instead of a plastic material, or an entirely different material could be used. The brace has been illustrated as having a generally cylindrical shape with a plurality of ridges and valleys spaced around an outer circumference, but it is not necessary that the brace have a cylindrical shape or that it have the ridges or valleys. The cross-section of the brace could have a different shape such as rectangular, square or hexagonal, and rather than ridges or valleys for making the outer surface easier to grip, the outer surface could be a knurled surface.

Embodiments of the Invention

There arc many different embodiments of the invention including the following.

1. A brace for supporting a first thing against a second thing, comprising:

a connector that can be attached to the toilet tank, wherein the connector has a threaded element; an adjustment spacer having a threaded end and an opposing interlocking end, wherein the threaded end is or can be threadedly engaged with the threaded element of the connector, wherein rotation of the adjustment spacer with respect to the connector alters a combined length of the connector and the adjustment spacer, and wherein the interlocking end has either a protruding stud or a hole; and a fixed-length spacer having opposing ends, wherein one of the ends has either a recess for receiving the stud or a projection that fits securely in the hole so that the fixed-length spacer is in or can be in an interlocking engagement with the adjustment spacer.

2. The brace of embodiment 1, wherein the connector is a U-shaped clip that fits over an upper edge of the toilet tank or a plate and an adhesive for bonding the plate to the toilet tank or a mechanical fastener such as a plate with wood or machine screws.

3. The brace of embodiment 1 or 2, further comprising one or more spacer lengths that are or can be interlocked with the fixed-length spacer and/or with each other in the same manner in which the fixed-length spacer is placed in the interlocking engagement with the adjustment spacer.

4. The brace of embodiment 1, 2 or 3, further comprising one or more spacer lengths that are or can he interlocked with the fixed-length spacer and/or with each other in the same manner in which the fixed-length spacer is placed in the interlocking engagement with the adjustment spacer.

5. The brace of any one of embodiments 1-4, further comprising an end cap that has a locking end and an opposing smooth end for placement against the wall, wherein the locking end is or can be interlocked with the fixed-length spacer in the same manner in which the fixed-length spacer is placed in the interlocking engagement with the adjustment spacer.

6. The brace of any one of embodiments 1-4, further comprising an end cap that has a locking end and an opposing smooth end for placement against the wall, wherein the locking end is or can be interlocked with an outermost spacer length in the same manner in which the fixed-length spacer is placed in the interlocking engagement with the adjustment spacer.

7. The brace of embodiment 5 or 6, wherein each of the adjustment spacer, fixed-length spacers and end cap have a length and an outer surface, and wherein the outer surface of each has a plurality of ridges and valleys along the length so that the outer surface can be gripped and rotated.

8. The brace of any one of embodiments 5-7, wherein each of the adjustment spacer, fixed-length spacers and end cap has either an alignment pin or an alignment opening for aligning the plurality of ridges and valleys along the brace due to engagement of one alignment pin in one corresponding alignment opening.

9. The brace of embodiment 1, wherein the connector is a U-shaped clip that fits over an upper edge of the toilet tank and has a threaded stud located so that it will project away from the toilet tank and toward the wall, wherein the adjustment spacer is an adjustment nut that has a length, a longitudinal axis and a structure that includes female threads around the longitudinal axis for receiving the threaded stud, and one or more spacer lengths that are or can be interlocked with the fixed-length spacer and or with each other in the same manner in which the fixed-length spacer is placed in the interlocking engagement with the adjustment spacer.

10. The brace of embodiment 1, wherein the connector is a U-shaped clip that fits over an upper edge of the toilet tank and has a threaded stud located so that it will project away from the toilet tank and toward the wall, wherein the threaded end of the adjustment spacer has female threads and is threaded onto the threaded stud, wherein the interlocking end of the adjustment spacer has an interlocking hole, and wherein the fixed-length spacer has an interlocking projection that is pressed into the interlocking hole, thereby removably attaching the fixed-length spacer to the adjustment spacer.

11. The brace of embodiment 1, wherein the connector is a plate and a layer of adhesive on the plate for bonding the plate to the toilet tank, wherein the connector has a threaded stud located so that it will project away from the toilet tank and toward the wall, wherein the adjustment spacer is an adjustment nut that has a length, a longitudinal axis and a structure that includes female threads around the longitudinal axis for receiving the threaded stud, and one or more spacer lengths that are or can be interlocked with the fixed-length spacer and or with each other in the same manner in which the fixed-length spacer is placed in the interlocking engagement with the adjustment spacer.

12. The brace of embodiment 1, wherein the connector is a plate and a layer of adhesive on the plate for bonding the plate to the toilet tank, wherein the connector has a threaded stud located so that it will project away from the toilet tank and toward the wall, wherein the threaded end of the adjustment spacer has female threads and is threaded onto the threaded stud, wherein the interlocking end of the adjustment spacer has an interlocking hole, and wherein the fixed-length spacer has an interlocking projection that is pressed into the interlocking hole, thereby removably attaching the fixed-length spacer to the adjustment spacer.

13. A method for bracing a toilet tank against a wall, comprising the steps of: obtaining and assembling the brace of any one of embodiments 1-12; placing the brace on the toilet tank between the toilet tank and the wall; and rotating the adjustment spacer to an extent that the toilet tank is braced against the wall through the brace of claim 1, wherein there is no need to cut an portion of the brace to a desired size or length.

14. A method for supporting a thing having feet or legs on a floor, comprising the steps of: obtaining and assembling the brace of any one of embodiments 1-12; placing the brace on one or more of the feel or legs between the thing and the floor; and rotating the adjustment spacer to an extent that the thing is supported by the floor through the brace of any one of embodiments 1-12, wherein there is no need to cut any portion of the brace to a desired size or length.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A brace for supporting a toilet tank against a wall, comprising:

a connector that can be attached to the toilet tank, wherein the connector has a threaded element;

an adjustment spacer having a threaded end and an opposing interlocking end, wherein the threaded end is threadedly engaged with the threaded element of the connector, wherein rotation of the adjustment spacer with respect to the connector alters a combined length of the connector and the adjustment spacer, and wherein the interlocking end has either a protruding stud or a hole; and a fixed-length spacer having opposing ends, wherein one of the ends has either a recess for receiving the stud or a projection that fits securely in the hole, wherein the fixed-length spacer is in an interlocking engagement with the adjustment spacer.

2. The brace of claim 1, wherein the connector is a U-shaped clip that fits over an upper edge of the toilet tank or a plate and an adhesive for bonding the plate to the toilet tank.

3. The brace of claim 2, further comprising a first spacer interlocked with the fixed-length spacer in a same manner in which the fixed-length spacer is placed in the interlocking engagement with the adjustment spacer.

4. The brace of claim 3, further comprising an end cap that has a locking end and an opposing smooth end for placement against the wall, wherein the locking end has a structure that allows it to be interlocked with the first spacer in the same manner in which the fixed-length spacer is placed in the interlocking engagement with the adjustment spacer.

5. The brace of claim 4, wherein each of the adjustment spacer, the fixed-length spacer and the end cap has a length and an outer surface, and wherein the outer surface of each has a plurality of ridges and valleys along the length so that the outer surface can be gripped and rotated.

6. The brace of claim 5, wherein each of the adjustment spacer, the fixed-length spacer and the end cap has either an alignment pin or an alignment opening for aligning the plurality of ridges and valleys along the brace due to engagement of one alignment pin in one corresponding alignment opening.

7. The brace of claim 1, further comprising a first spacer interlocked with the fixed-length spacer in a same manner in which the fixed-length spacer is placed in the interlocking engagement with the adjustment spacer.

8. The brace of claim 1, further comprising an end cap that has a locking end and an opposing smooth end for placement against the wall, wherein the locking end has a structure that allows it to be interlocked with the fixed-length spacer in the same manner in which the fixed-length spacer is placed in the interlocking engagement with the adjustment spacer.

9. The brace of claim 1, wherein the connector is a U-shaped clip that fits over an upper edge of the toilet tank and has a threaded stud located so that it will project away from the toilet tank and toward the wall, and wherein the adjustment spacer is an adjustment nut that has a length, a longitudinal axis and a structure that includes female threads around the longitudinal axis for receiving the threaded stud, further comprising one or more spacer lengths that can be interlocked with the fixed-length spacer or with each other in the a manner in which the fixed-length spacer is placed in the interlocking engagement with the adjustment spacer.

10. The brace of claim 1, wherein the connector is a U-shaped clip that fits over an upper edge of the toilet tank and has a threaded stud located so that the threaded stud will project away from the toilet tank and toward the wall, wherein the threaded end of the adjustment spacer has female threads and is threaded ono the threaded stud, wherein the interlocking end of the adjustment spacer has an interlocking hole, and wherein the fixed-length spacer has an interlocking projection that is pressed into the interlocking hole, thereby removably attaching the fixed-length spacer to the adjustment spacer.

11. A method for bracing a toilet tank against a wall, comprising step of:

obtaining and assembling the brace of claim 1;

placing the brace on the toilet tank between the toilet tank and the wall; and rotating the adjustment spacer to an extent that the toilet tank is braced against the wall through the brace of claim 1, wherein there is no need to cut any portion of the brace to a desired size or length.

12. A brace for supporting a toilet tank against a wall, comprising:

a connector having a structure that allows attachment of the connector to the toilet tank;

an end cap for resting against the wall;

a first spacer detachably attached to the connector; and a second spacer detachably attached to the first spacer and detachably attached to the end cap.

13. The brace of claim 12, wherein the second spacer is detachably attached to the first spacer by a stud-and-tube coupling system.

14. The brace of claim 12, wherein the first spacer has a stud that projects outwardly or a hole that is recessed inwardly, wherein the second spacer has either a mating recess for receiving the stud or a mating projection for insertion into the hole in an interference fit.

15. The brace of claim 14, wherein the first spacer is threadedly engaged with the connector in a manner such that rotation of the first spacer alters the distance between the connector and the end cap.

16. A method for bracing a toilet tank against a wall, comprising steps of:

obtaining and assembling the brace of claim 12; and placing the brace on the toilet tank between the toilet tank and the wall.

17. The method of claim 16, wherein the first spacer is threadedly engaged with the connector in a manner such that rotation of the first spacer alters the distance between the connector and the end cap.

18. The method of claim 16, wherein there is no need to cut any portion of the brace to a desired size or length.

19. A support device for supporting or bracing a first thing against a second thing, comprising:

a connector that can be attached to the first thing, wherein the connector is designed to be attached to the first thing by a U-shaped clip or by adhesion or by a mechanical fastener, wherein the connector has an interlocking mechanism; and a first spacer having a desired length that is detachably attached to the connector through a press fit with the interlocking mechanism, wherein the connector includes a threaded element and an adjustment spacer having a threaded end and an opposing interlocking end, wherein the threaded end is threadedly engaged with the threaded element, wherein rotation of the adjustment spacer with respect to the threaded element alters the length of the connector, and wherein the interlocking mechanism has either a protruding stud or a hole.

20. The support device of claim 19, further comprising a second spacer detachably attached to the first spacer.

21. The support device of claim 19, wherein the first spacer has opposing ends, wherein one of the ends has either a recess for receiving the stud or a projection that fits securely in the hole so that the first spacer is in an interlocking engagement with the adjustment spacer.

22. The support device of claim 21, wherein connector includes a plate and a layer of adhesive on the plate.

23. A method for supporting or bracing a first thing against a second thing, comprising steps of:

obtaining and assembling the support device of claim 19, wherein the first thing has legs or feet, and wherein the second thing is a floor or other generally horizontal, planar surface; and placing the support device between the first and second things.

24. A method for bracing a toilet tank against a wall, comprising: obtaining and assembling the support device of claim 19, wherein the connector includes a plate and a layer of adhesive on the plate; and bonding the plate to the toilet tank with the layer of adhesive.

* * * * *